US012195870B2

(12) United States Patent
Pesavento et al.

(10) Patent No.: US 12,195,870 B2
(45) Date of Patent: Jan. 14, 2025

(54) MICROETCH NEUTRALIZER CHEMISTRY FOR Ni—Au PLATING DEFECT ELIMINATION

(71) Applicant: Hutchinson Technology Incorporated, Hutchinson, MN (US)

(72) Inventors: Paul V. Pesavento, Hutchinson, MN (US); Douglas P. Riemer, Waconia, MN (US); David A. Brouchous, Hutchinson, MN (US)

(73) Assignee: Hutchinson Technology Incorporated, Hutchinson, MN (US)

( * ) Notice: Subject to any disclaimer, the term of this patent is extended or adjusted under 35 U.S.C. 154(b) by 0 days.

(21) Appl. No.: 17/466,749

(22) Filed: Sep. 3, 2021

(65) Prior Publication Data

US 2022/0074067 A1 Mar. 10, 2022

Related U.S. Application Data

(60) Provisional application No. 63/074,639, filed on Sep. 4, 2020.

(51) Int. Cl.

| | |
|---|---|
| ***C25D 5/34*** | (2006.01) |
| ***C25D 3/12*** | (2006.01) |
| ***C25D 3/48*** | (2006.01) |

(52) U.S. Cl.

CPC ..... *C25D 5/34* (2013.01); *C25D 3/12* (2013.01); *C25D 3/48* (2013.01)

(58) Field of Classification Search

None

See application file for complete search history.

(56) References Cited

U.S. PATENT DOCUMENTS 4,592,809 A * 6/1986 Fong ..... C07C 305/10 205/244
5,985,040 A 11/1999 Carano et al.
2004/0038840 A1 2/2004 Lee et al.
2011/0146707 A1* 6/2011 Cermenati ..... C11D 7/265 134/6
2014/0264191 A1* 9/2014 Rantala ..... C23C 18/36 427/58

FOREIGN PATENT DOCUMENTS

CN 109609934 A * 4/2019
EP 747507 A1 * 12/1996 ..... C23C 18/1651
EP 2945495 A1 * 11/2015 ..... A23B 7/10

OTHER PUBLICATIONS

Bao et al. (CN 109609934 A, machine translation). (Year: 2019).*
ASTM International, ASTM A967-05e1, "Standard Specification for Chemical Passivation Treatments for Stainless Steel Parts", approved Sep. 1, 2005.
ASTM International, ASTM A380-06, "Standard Practice for Cleaning, Descaling, and Passivation of Stainless Steel Parts, Equipment, and Systems", approved May 1, 2006.
SAE International, AMS2700C, Aerospace Material Specification, "Passivation of Corrosion Resistant Steels", revised Nov. 2008.
Clarke et al., "Moolooite, a Naturally Occurring Hydrated Copper Oxalate from Western Australia", Mineralogical Magazine, vol. 50, No. 356, pp. 295-298, Jun. 1986.
Edwards et al., "Vibrational spectra of copper (II) oxalate dihydrate, CuC204•2H2O, and dipotassium bis-oxalato copper (II) tetrahydrate, K2Cu(C2O4)2•4H2O", Journal of Molecular Structure, vol. 249, pp. 233-243, Sep. 1991.

* cited by examiner

*Primary Examiner* — Wojciech Haske
(74) *Attorney, Agent, or Firm* — DLA Piper LLP (US)

(57) ABSTRACT

A neutralizing composition comprising ascorbic acid as a reducing agent, citric acid as a chelator and a pH adjusting agent applied to microetched copper substrates bussed to stainless steel, which have been cleaned with an agent comprising permanganate ions. Unlike the prior art neutralizing agents comprising oxalic acid, which leave insoluble residue on the surface of the copper substrate, the present neutralizing composition leaves no residue and acts quickly. A surprising reduction in defects of Ni—Au plated copper substrates is achieved by utilization of the neutralization composition in a manufacturing process.

12 Claims, 4 Drawing Sheets

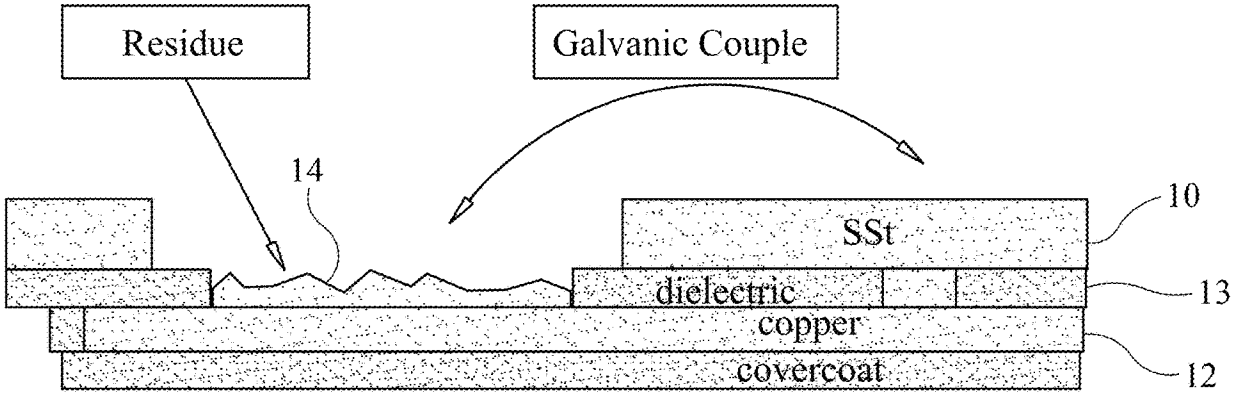
FIG. 3
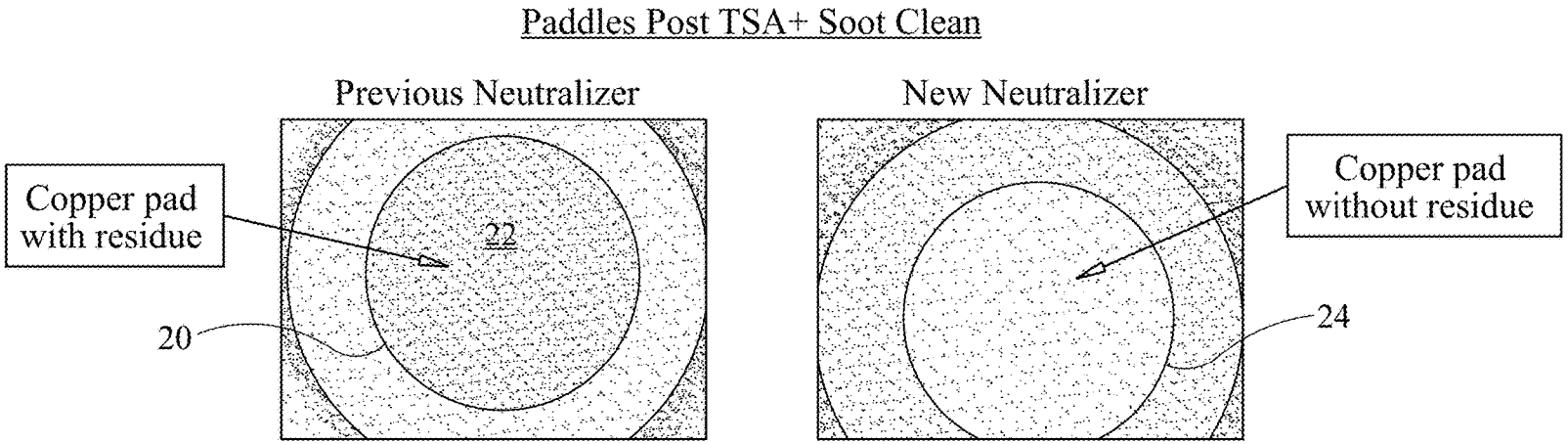
FIG. 4A
FIG. 4B

MICROETCH NEUTRALIZER CHEMISTRY FOR Ni—Au PLATING DEFECT ELIMINATION

CROSS-REFERENCE TO RELATED APPLICATIONS

This application claims the benefit of, and priority to, U.S. Provisional Application No. 63/074,639 filed on Sep. 4, 2020, which is hereby incorporated by reference in its entirety.

FIELD

The present disclosure is directed to eliminating surface finish plating defects. In some embodiments, surface plating defects are virtually eliminated, for example reducing the yield loss from greater than 95% to less than 1.0%. By adopting novel chemistry based on a combination of mild organic acids, a reducing agent and a chelator, the problems of the prior art are overcome. The new chemistry preferably comprises ascorbic acid, citric acid and sodium hydroxide as a pH adjuster.

BACKGROUND

The current state of the art for chemically "passivating" and/or "derouging" stainless steels is primarily based on mineral or organic acids according to one or more of the standards set forth in ASTM A380, ASTM A 967 and SAE AMS 2700C, each of which are herein incorporated by reference in their entireties. Most mineral acids, such as nitric acid, hydrofluoric acid and sulfuric acid, and organic acids, such as oxalic acid, citric acid, and ethylene-diamine-tetra-acetic acid ("EDTA"), must be used at elevated concentration and temperature for extended periods of time, such as approximately 1-10 wt. %, 21°-80° C., and 5-30 minutes, respectively.

As shown in FIG. 1 (Prior Art) assault on stainless steel surface are oxidative reactions due to chrome etch and plasma clean of the stainless steel according to the following reactions:

$$3\ MnO_4^- + Cr^{3+} \rightarrow 3MnO_4^{2-} + Cr^{6+}\ \text{(soluble)}$$

$$MnO_4^- + Fe^{2+} \rightarrow MnO_4^{2-} + Fe^{3+}\ \text{(insoluble)}$$

Historical passivation of stainless steel has been accomplished using mineral acids ($HNO_3$) and more recently citric acid.

In dual stage actuator (DSA) flexure nickel-gold (Ni—Au) plating, defects currently include severe missing and out-of-specification thickness Ni—Au plating as shown in the photomicrograph of FIG. 2. The defects occur on the stainless steel side of the copper paddle, but are also present on other areas of other part designs, such as test pads. These defects induce greater than 90% yield loss. Furthermore, inspection is difficult with automated systems. Even with a manual sort, escapement risk is high. There is also a high risk of high resistance DSA electrical connections and/or poor reliability over time.

Alternatively, the residue detected after a Soot Clean neutralizer bath, utilizing oxalic acid, deposits a residue on the DSA paddles, flexure features that are responsible for piezo motor electrical connections. The residue deposits on the copper portion of the pad, which subsequently prevents proper plating of the surface finish layers currently consisting of nickel (Ni) and gold (Au). While oxalic acid is a good choice for stainless steel passivation and a reasonable choice for neutralization of the chrome microetch chemistry, the poor solubility of its salts (copper oxalate, iron oxalate, nickel oxalate, etc.) allows precipitation residue to form on any surface composed of copper, iron, or nickel that is being actively etched. Given the current DSA part configuration, where the paddles are electrically connected to the stainless steel, there exists a galvanic couple between the stainless steel surface when immersed in the oxalic acid. The copper pad is anodic to the stainless steel by several hundred millivolts (a very large value in electrochemical terms) which drives etching of the copper surface, primarily on the stainless steel side. This results in copper ions being emitted into the oxalic acid solution and the formation of the insoluble copper oxalate salt. This salt precipitates out of solution onto the copper pad which is not removed by any existing cleaning process between Soot Clean and Ni—Au Plate. Due to its poor solubility, aqueous cleaning methods targeted at removing the copper oxalate residue will be unsuccessful.

Thus, there is a long standing need for a neutralizer formulation that prevents residue formation, neutralizes permanganate from chrome etch, conditions stainless steel for good passivation, and mitigates need for significant capital expenditure.

SUMMARY

In one embodiment, a neutralizer formulation or composition is based on mild organic acids. In some embodiments, a neutralizing composition is provided comprising: a reducing agent, a chelator and a pH adjuster. Ascorbic acid, citric acid and a pH adjuster, such as sodium hydroxide, to control pH to about 2.0 can be used. In some embodiments, the reducing agent is a carboxylic acid selected from the group consisting of tartaric acid, acetic acid, malic acid, malonic acid, ascorbic acid, lactic acid, succinic acid, and salts thereof; and the chelator is citric acid. In some embodiments, the reducing agent is present in an amount in the range of 12-18 wt. %, the chelator in an amount in the range of 11-15 wt. %, and the pH adjuster in an amount to bring the pH of the composition to a pH of about 2. In another embodiment, a composition is provided comprising: ascorbic acid in an amount of 15 wt. %, citric acid in an amount of 12 wt. %, and sodium hydroxide in an amount sufficient to achieve a pH of the composition of about 2.

In another embodiment this neutralizer formulation is operative in a process conducted at temperatures not exceeding 50° C., and for a residence time not exceeding about 30 seconds.

In another embodiment, the neutralizer formulation and method of use eliminates Ni—Au plating defects, substantially reducing the yield loss. In some embodiments, yield loss is reduced from >90% to <10.0%, <5.0%, <1.0% and even <0.1% when combined with plasma treatment before Ni—Au Plate.

In another embodiment, the need for significant capital expenditure in the manufacturing process is mitigated.

In a still further embodiment, short processing times enable higher manufacturing line throughput without requiring capital expenditure (or a longer module or new line). For example, in another aspect, a process of finish plating a copper substrate bussed to stainless steel with a nickel plating, followed by a gold plating over the nickel plating is provided, the process comprising recovering a microetched copper substrate bussed to a stainless steel; cleaning the copper substrate with an alkaline solution comprising permanganate ions; contacting a neutralizing composition with the cleaned copper substrate, wherein the neutralizing composition comprises ascorbic acid in an amount of 15 wt. %, citric acid in an amount of 12 wt. %, and sodium hydroxide in an amount sufficient to achieve a pH of the composition of about 2, and thereafter plating the nickel directly on the copper substrate and thereafter plating the gold on the nickel plating.

These and other embodiments will be better understood when read in conjunction with the detailed description and the appended drawings.

BRIEF DESCRIPTION OF THE DRAWINGS

FIG. 3 is a schematic representation of the galvanic couple formed between the stainless steel and the copper and the presence of a residue formed by neutralization with oxalic acid.

FIG. 4A is a photograph of a copper pad with residue using a neutralizer or composition including oxalic acid.

FIG. 4B is a photograph of a copper pad without residue utilizing the neutralizer or composition disclosed herein.

DETAILED DESCRIPTION OF THE EMBODIMENTS

Figure 1:
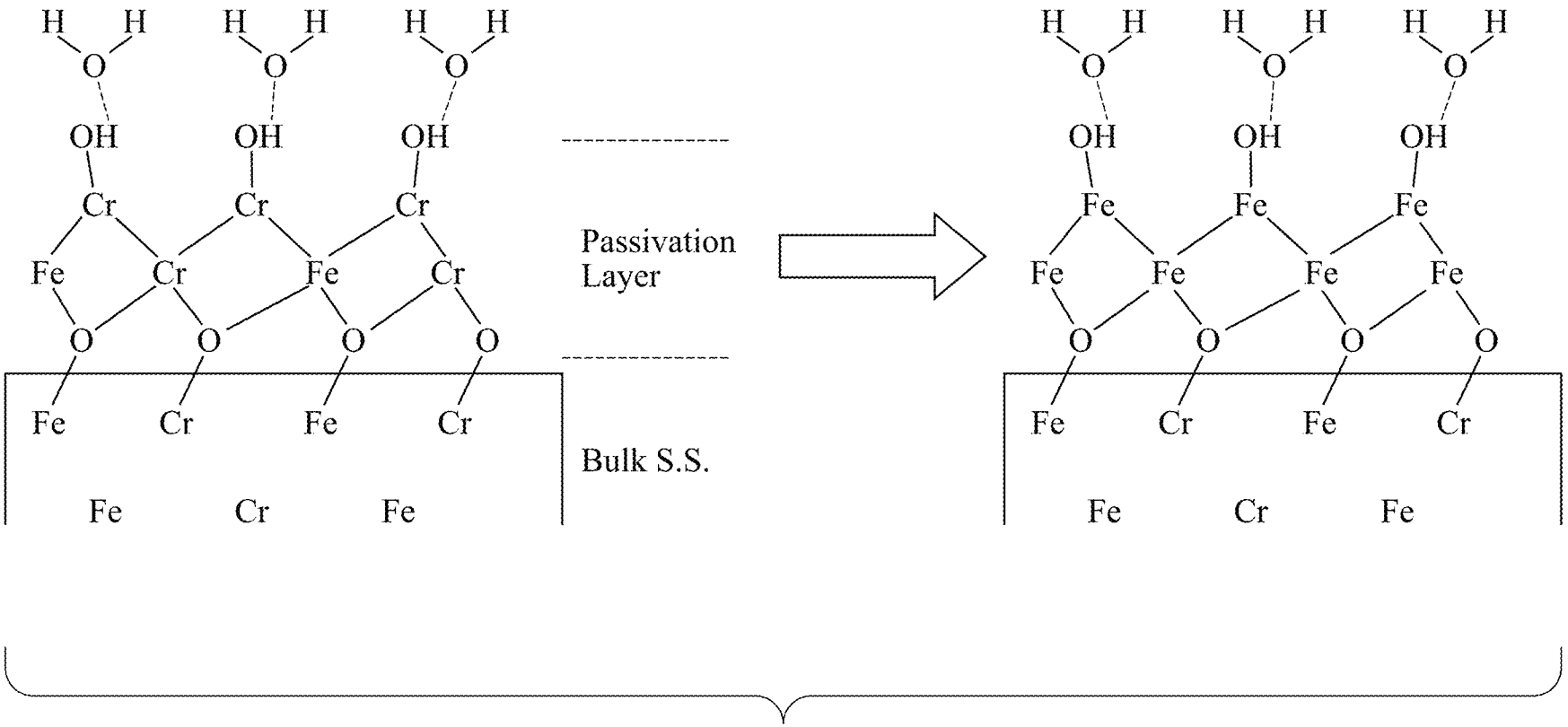
FIG. 1 (PRIOR ART)
FIG. 1 (Prior Art) is a schematic representation of assault on stainless steel surface by oxidative reactions due to chrome etch and plasma clean of the stainless steel.
Figure 2:
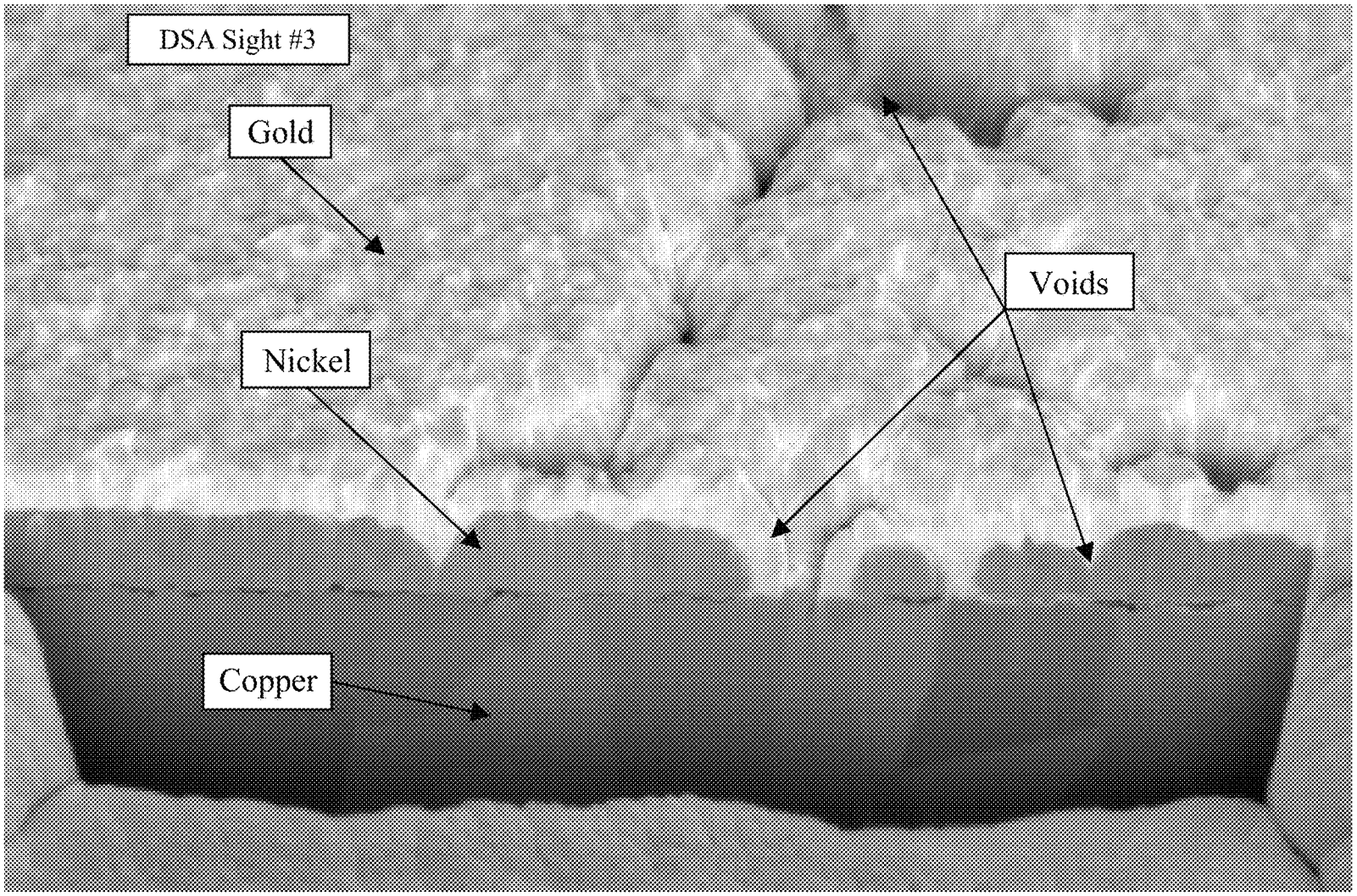
FIG. 2 is a photomicrograph of a copper substrate electroplated with Ni—Au, illustrating formation of voids in the plating.

As shown in FIG. 1 (Prior Art), the assault on stainless steel surfaces are oxidative reactions due to chrome etch and plasma clean of the stainless steel. Historically, stainless steel passivation has been accomplished using mineral acids ($HNO_3$). Other mineral acids, such as hydrofluoric acid and sulfuric acid have also been used. Used alone, organic acids such as oxalic acid, citric acid and ethylene-diamine-tetra-acetic acid (EDTA) used in the prior art processes must be used at elevated concentration and temperature for extended times, such as approximately 1-10 wt. %, 21°–80° C., for 5-30 minutes, respectively.

While mineral acids have been used historically, the typical mineral acid process will etch away conductors on the stainless steel rendering it unsuitable, which has led to the use of organic acids. However, the typical organic acid, oxalic acid, forms insoluble salts as described above and thus is undesirable.

As shown in the schematic representation of FIG. 3, the stainless steel 10 and copper 12 form a galvanic couple in the presence of oxalic acid. This can occur in a printed circuit board 13 comprised of dielectric thermosetting or composite materials, such as a polymer containing fibrous reinforcement. The copper is anodic to the stainless steel by several hundred millivolts (a very large value in electrochemical terms) which drives etching of the copper surface, primarily on the stainless steel side. This results in copper ions being emitted into the oxalic acid solution and the formation of the insoluble residue 14. FTIR analysis of residue 14 confirmed the residue 14 a match to hydrated copper oxalate ("moolooite").

As shown in FIG. 4A, a copper pad 20 has a residue 22 deposited thereon utilizing the oxalic acid as a neutralizer. By contrast, the neutralizer formulation according to the present embodiment leaves no residue on pad 24, as shown in FIG. 4B.

Turning to the inventive neutralizer formulation or composition of the present disclosure, the composition is comprised of mild organic acids. Ascorbic acid, citric acid and a pH adjuster, such as sodium hydroxide, to control pH to about 2.0 can be used. The microetch process utilizes a cleaning agent to remove the soot, wherein the cleaning agent comprises permanganate ions. The neutralizer according to the present embodiments can neutralize the permanganate ions in about 1 second. The neutralizer composition of the present disclosure comprises a mild organic acid, such as a carboxylic acid selected from the group consisting of tartaric acid, acetic acid, malic acid, malonic acid, ascorbic acid, lactic acid, succinic acid, and salts thereof, a chelator, such as citric acid, and a pH adjusting agent, such as sodium hydroxide, potassium hydroxide and lithium hydroxide. Typically, sodium hydroxide, potassium hydroxide and mixtures thereof are used. Sodium hydroxide is preferred. As the mild organic acid can be used ascorbic acid, which acts as a reducing agent. As the chelator can be used citric acid, or equivalent. Adjustment of the pH by the base should be in an amount effective to bring the pH to about 2. The mild organic acid can be present in an amount of from 12 to 18 wt. %, the chelator can be present in an amount of from 11 to 15 wt. % and sufficient pH adjuster to bring the pH of the composition to about 2. In some embodiment, use of the formulation according to the present disclosure is carried out at temperatures up to and including 50° C. for a period of about 30 seconds. In other embodiments, use of the formulation according to the present disclosure is carried out at temperatures above 50° C. Conventional surfactants may be included in the compositions. Such surfactants include ionic, non-ionic and amphoteric surfactants. Among the ionic surfactant, cationic and anionic surfactants can be used. Mixtures of the surfactants can also be used. Surfactants may be included in the compositions in amounts between 0.001 g/L to 50 g/L.

The neutralizer formulation of the present disclosure permits much shorter processing times than were experienced by prior art formulations. The shorter processing times allowed by the chemistry of the formulations of the disclosure enable high manufacturing line throughput. Processing times of 30 seconds are attainable. The current state of the art utilizing organic acids, when processing at temperatures less than 50° C., require a minimum immersion time of 60 minutes which would not likely lend itself well to a continuous process, but rather would likely require a batch-based immersion tank. In contrast, the neutralizer composition of the present disclosure can effectively neutralize the permanganate ions present in the soot cleaning chemistry almost instantaneously, and within one second of contact, at temperatures of about 50° C. After neutralization, the copper substrate can be treated with plasma to further prepare the substrate for Ni—Au plating.

Figure 5:
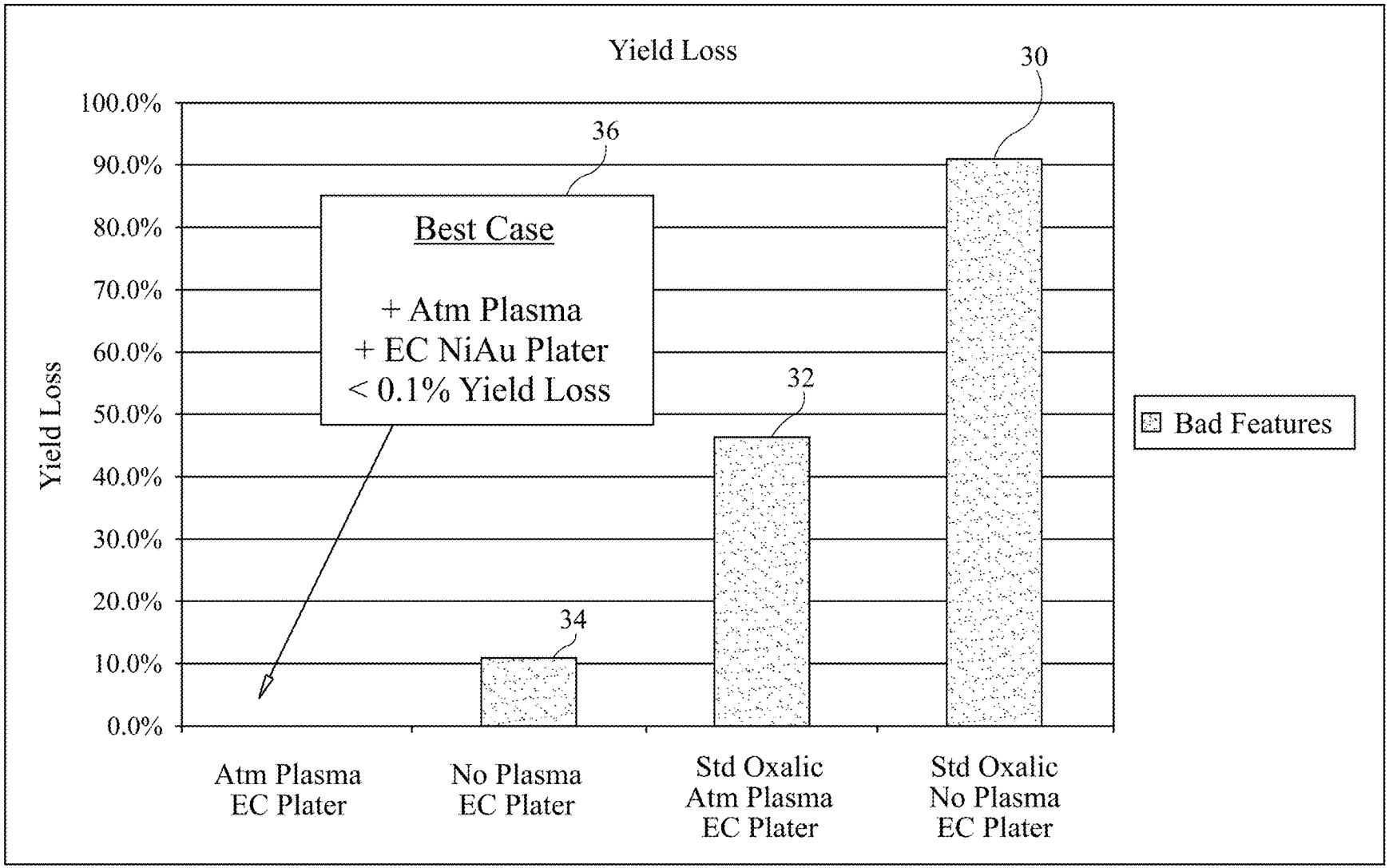
FIG. 5 is a graphical representation of % defects plotted against the systems utilizing: (1) oxalic acid without plasma treatment, (2) oxalic acid with plasma treatment, (3) the formulation of the present disclosure, and (4) the formulation of the present disclosure plus plasma treatment.

FIG. 5 is a graphic representation of the remarkable and surprising decrease in defects of the Ni—Au electroplating when the neutralizer of this disclosure is utilized in place of the oxalic acid neutralizer 30 of the prior art. Even in the absence of the best case scenario of utilizing plasma treatment in combination with the present formulation 36, the present formulation 34 exhibits unexpected improvement over the oxalic acid neutralizer of the prior art even when combined with plasma treatment 32, such that the disclosed formulation of the embodiments produces an unexpected reduction in defects in the subsequent Ni—Au plating.

Example

The following example is provided for illustration purposes only and is not intended to limit the scope or teaching of the invention in any way.

A formulation of neutralizer comprising ascorbic acid as the reducing agent in an amount of 15 wt. %, a chelator comprising citric acid in an amount of about 12 wt. %, and sufficient base, such as sodium hydroxide, to adjust the pH to about 2, was made. In one example the formulation was heated to temperatures up to and including about 50° C. for a time of about 30 seconds to form a residue free copper surface and neutralizes permanganate from a chrome etch. It also conditions stainless steel for good passivation. Subsequent Ni—Au plating on the residue free copper surface results in defects less than 10%. When combined with a plasma treatment before plating, defects were reduced to less than 0.1%. When utilized in a continuous process, machine throughput was increased to 3 meters per minute.

While we have described certain embodiments, it should be understood that such embodiments are illustrative only and not limiting, as one of ordinary skill in the art, to which this disclosure is directed, will understand that other embodiments of this disclosure and modifications of the disclosed embodiments can be achieved without the exercise of invention.

We claim:

1. A neutralizing composition for use in a passivation process, the neutralizing composition consisting essentially of:

a reducing agent, wherein the reducing agent is a carbocyclic acid selected from the group consisting of tartaric acid, acetic acid, malic acid, malonic acid, ascorbic acid, lactic acid, succinic acid, and salts thereof;

a chelator consisting of citric acid, ethylene diamine tetra-acetic acid (EDTA), or other divalent cation chelator;

a pH adjuster selected from the group consisting of sodium hydroxide, potassium hydroxide, and mixtures thereof; and one or more surfactants wherein the one or more surfactants are present in a concentration between 0.001 g/L to 50 g/L.

2. The neutralizing composition of claim 1, wherein the reducing agent is present in an amount in the range of 12-18 wt. %, the chelator in an amount in the range of 11-15 wt. %, and the pH adjuster in an amount to bring the pH of the composition to a pH of about 2.

3. The neutralizing composition of claim 1, wherein the reducing agent comprises ascorbic acid, the chelator comprises citric acid and the pH adjuster is selected from the group consisting of sodium hydroxide, potassium hydroxide, and mixtures thereof.

4. The neutralizing composition of claim 1 further comprising:

the reducing agent is ascorbic acid in an amount of 15 wt. %, the chelator is citric acid in an amount of 12 wt. %, and the pH adjuster is sodium hydroxide in an amount sufficient to achieve a pH of the composition of about 2.

5. A process of finish plating a copper substrate bussed to stainless steel with at least one selected from the group consisting of nickel and gold, comprising:

recovering a microetched copper substrate bussed to stainless steel;

cleaning the copper substrate with an alkaline solution comprising permanganate ions; and contacting a neutralizing composition with the cleaned copper substrate, wherein the neutralizing composition comprises the composition of claim 1, and thereafter plating on the copper substrate at least one selected from the group consisting of nickel and gold.

6. A process of finish plating a copper substrate bussed to stainless steel with at least one selected from the group consisting of nickel and gold, comprising:

recovering a microetched copper substrate bussed to a stainless steel;

cleaning the copper substrate with an alkaline solution comprising permanganate ions; and contacting a neutralizing composition with the cleaned copper substrate, wherein the neutralizing composition comprises the composition of claim 2, and thereafter plating on the copper substrate at least one selected from the group consisting of nickel and gold.

7. A process of finish plating a copper substrate bussed to stainless steel with at least one selected from the group consisting of nickel and gold, comprising:

recovering a microetched copper substrate bussed to a stainless steel;

cleaning the copper substrate with an alkaline solution comprising permanganate ions; and contacting a neutralizing composition with the cleaned copper substrate, wherein the neutralizing composition comprises the composition of claim 4, and thereafter plating on the copper substrate at least one selected from the group consisting of nickel and gold.

8. The process of claim 7, wherein the contacting step is carried out at a temperature up to about 50° C.

9. The process of claim 8, wherein the contacting step does not exceed about 30 seconds.

10. The process of claim 9, wherein the contacting step is performed as a continuing process and further comprising performing the contacting step at a speed of 3 meters/minute.

11. The process of claim 7, wherein the permanganate is neutralized in about 1 second.

12. The process of claim 7, wherein nickel is plated directly on the copper substrate to form a nickel plating and the gold is plated on the nickel plating.

* * * * *